US005404132A

United States Patent [19]

Canty et al.

[11] Patent Number: 5,404,132

[45] Date of Patent: Apr. 4, 1995

[54] DEFLECTION MONITORING SYSTEM

[76] Inventors: Jeffery N. Canty, P.O. Box 688, Mattapoisett, Mass. 02739; Charles W. Canty, 261 Falconer Ave., Brockton, Mass. 02401

[21] Appl. No.: 212,041

[22] Filed: Mar. 14, 1994

[51] Int. Cl.[6] ..... G08B 13/183

[52] U.S. Cl. ..... 340/686; 52/741.3; 250/222.1; 340/540; 340/666

[58] Field of Search ..... 340/686, 666, 540; 250/222.1, 224; 52/741.3

[56] References Cited

U.S. PATENT DOCUMENTS

| | | | |
|---|---|---|---|
| 3,335,285 | 8/1967 | Gally, Jr. et al. | 250/221 |
| 3,711,846 | 1/1973 | Schlisser et al. | 340/557 |
| 4,429,496 | 2/1984 | Masri | 5/1 |
| 4,843,372 | 6/1989 | Savino | 340/540 |
| 4,889,997 | 12/1989 | Tomiolo | 250/561 |
| 4,936,060 | 6/1990 | Gelinas et al. | 52/1 |
| 4,956,947 | 9/1990 | Middleton | 52/1 |
| 4,964,246 | 10/1990 | Kobori et al. | 52/1 |

FOREIGN PATENT DOCUMENTS

0377880A1 7/1990 European Pat. Off. .

*Primary Examiner*—Glen Swann

*Attorney, Agent, or Firm*—Richard C. Litman

[57] ABSTRACT

Deflections in support structures, due to external stress factors, can be detected by a series of laser beams. A laser is positioned at the perimeter of the structure. The laser generates a laser beam along a path adjacent to the structure, and the beam strikes a receiver across from the laser. Solid target blocks are positioned along the support structure. When deflection occurs in the support structure, the targets are concurrently displaced into the path of the laser beam. The receiver registers the break in the laser beam and activates an alarm. Each beam is set to detect deflection in the structure within predefined zones, and the alarm indicates the zone in which the laser beam path was broken by the deflection.

8 Claims, 2 Drawing Sheets

DEFLECTION MONITORING SYSTEM

BACKGROUND OF THE INVENTION

1. Field of the Invention

The instant invention relates to a detection monitoring system and in particular relates to monitoring deflections in a roof structure.

2. Description of the Prior Art

As a rigid structure is exposed to external stresses, the supporting structure will often begin to deform and display deflections before the structure actually fails and collapses. For example, as weight accumulates on a roof, it begins to overload the roof's supporting structure, causing deflections in the roof's structure. The stress of the weight may eventually overload the roof's structure, thereby causing the roof to collapse. There exists a need to monitor and detect these deflections to determine when a support structure such as a roof is in danger of collapse.

Some prior control systems measured the deformation resulting from earthquakes and other external forces. Some of these systems would respond to the deformation by applying countervailing forces to compensate for them. U.S. Pat. No. 4,964,264 issued to Takuji Korbori et al. on Oct. 23, 1990 describes a rigidity control system in which the tension of the control elements are adjusted to attenuate deformation in a building structure resulting from the vibrational forces of, e.g., an earthquake. U.S. Pat. No. 4,956,947 issued to Leonard E. Middleton on Sep. 18, 1990 describes a tendon system for inhibiting sway in a building. The tendon system is responsive to changes in the deflection of the building as measured by a steady beam focused on a sensor target on the building structure. U.S. Pat. No. 4,429,496 issued to Sami F. Masri on Feb. 7, 1984 describes a method and apparatus for the active control and dampening of flexible structures in response to vibrational shocks from earthquakes and other such events. A corrective force is applied to the structure in pulses to dissipate the vibrational energy from the earthquake and to disorganize the resulting harmonic motion of the structure.

Some prior control systems detect and monitor the deformation of a building structure, and trigger an alarm upon such detection. U.S. Pat. No. 4,889,997 issued to Andrea Tomiolo on Dec. 26, 1989 describes a process and device for measuring the displacement of building structures using laser beams. A rotating prism directs the laser beam towards various sensor targets, and any deviation from the last reading activates an alarm. U.S. Pat. No. 4,843,372 issued to Thomas Savino on Jun. 27, 1989 describes a bridge sway and deflection system using a laser and mirror system. A laser beam is generated at one side of a bridge and passed through a series of apertures placed along the supporting vertical columns of the bridge. If any deflection occurs along the bridge's support columns, the aperture will move out of alignment with the laser beam and signal a general structural fault in the bridge. Savino's system detects general faults in the bridge structure, but cannot localize the fault occurrence. Because movement of any one of the apertures could break the circuit created by the laser beam, Savino is not capable of detecting the fault's location.

Other systems are known in which a laser is used to detect objects which pass a certain threshold position. U.S. Pat. No. 3,711,846 issued to Gabor Schlisser et al. on Jan. 16, 1973 describes an alarm system wherein a laser beam is directed and repeated along the perimeter of an enclosed area. U.S. Pat. No. 3,335,285 issued to John Gally, Jr. et al. on Aug. 8, 1967 describes a photoelectric system for detecting objects using a laser light source.

Other detection and monitoring systems have used a variety of other types of sensors. U.S. Pat. No. 4,936,060 issued to Richard Gelinas et al. on Jun. 26, 1990 describes a flexible roof control system using a plurality of radar units to measure the height of the roof. Published European Patent Application No. 0 377 880 A1 for Giovanni Azzimonti and published on Jul. 18, 1990 describes a structural facade wherein each panel of the facade includes at least one sensor for signalling possible shifts of the panel.

None of the above patent references, either alone or in combination, is seen to describe the instant invention as claimed. While these and other patents disclose the use of lasers to measure misalignments and detect intrusions, the known prior art does not disclose or suggest the deflection monitoring system of the instant invention.

SUMMARY OF THE INVENTION

The object of the invention is to overcome the foregoing difficulties and shortcomings involved in deflection monitoring systems.

Another object of the invention is to provide a deflection monitoring system to warn of the impending collapse of a building structure based on the amount of deflection present in the structure.

Another object of the invention is to provide a system for determining a weight overload situation by monitoring the deflection in a roof structure.

Yet another object of the invention is to provide a system for monitoring the horizontal deflection in the joists or structural beams of a roof structure.

A further object of the invention is to provide a system of laser beams for defining a series of zones to enable the location of deflections along a structure with specificity.

To achieve the objects of the invention and in accordance with the purpose of the invention, as embodied and broadly described herein, a preferred embodiment of the invention includes a laser generating a laser beam along a path adjacent to the structure; a receiver for receiving the laser beam; at least one solid target block attached to the structure, extending radially away from the structure, and located between the path of the laser beam and the structure; and an alarm connected to the receiver; whereby the target block is displaced into the path of the laser beam by a deflection in the structure, wherein the alarm is triggered by the receiver when it no longer receives the laser beam.

These and other objects of the instant invention will become readily apparent upon further review of the following specification and drawings.

DETAILED DESCRIPTION OF THE PREFERRED EMBODIMENTS

Figure 1:
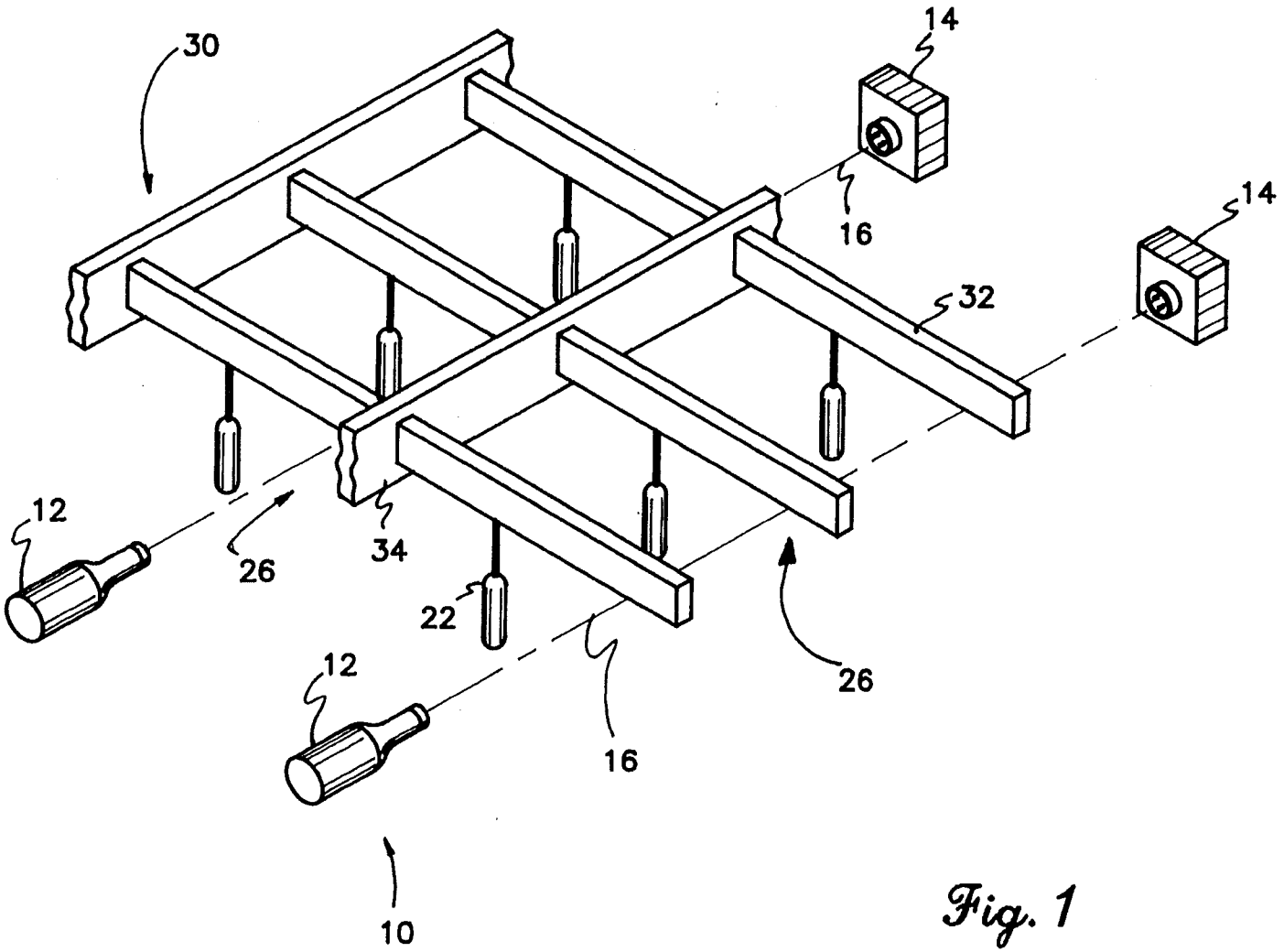
FIG. 1 is a partial perspective view of a preferred embodiment of the deflection monitoring system according to the instant invention.

Referring now to the accompanying drawings, a preferred embodiment of the instant invention is illustrated. None of the disclosed embodiments should be construed as limiting the scope of the instant invention. A preferred embodiment of the deflection detection system 10 of the instant invention includes laser 12 and target blocks 22 to signal a deflection condition. Lasers are preferred because they can emit a highly focused energy beam over long distances. Preferably, as shown in FIG. 1, the deflection detection system 10 of the instant invention is used on a roof structure 30. However, the deflection detection system may be used on a wall, bridge or any other structure susceptible to deflection before its failure or collapse.

A plurality of lasers 12 are placed at regular intervals along the perimeter of a structure 30. Lasers 12 project laser beams 16 along a path adjacent to the structure 30. Lasers 12 are preferably set in series along the side wall (not shown) at the perimeter of the frame structure 30 to generate laser beams 16 along a path perpendicular to the sets of joists 32 and parallel to the support beams 34.

Each laser beam 16 is directed towards a laser receiver 14. Lasers 12 and the corresponding receivers 14 are preferably placed a predetermined distance beneath structure 30. Receiver 14 is preferably an energy cell that is energized when laser beam 16 strikes receiver 14. The corresponding receivers 14 are preferably placed either along the opposite side wall from lasers 12 or on an independent support column that would be unaffected by deflection of structure 30. Each laser beam 16 is set to monitor a predetermined zone 26 along the structure in concert with opaque target blocks 22. Each receiver 14 is connected to a central alarm 18. Alarm 18 is activated when one of the receivers 14 loses contact with the laser beam 16. Alarm 18 preferably signals which zone 26 contains the deflection based on the outputs from the receivers 14.

Figure 2:
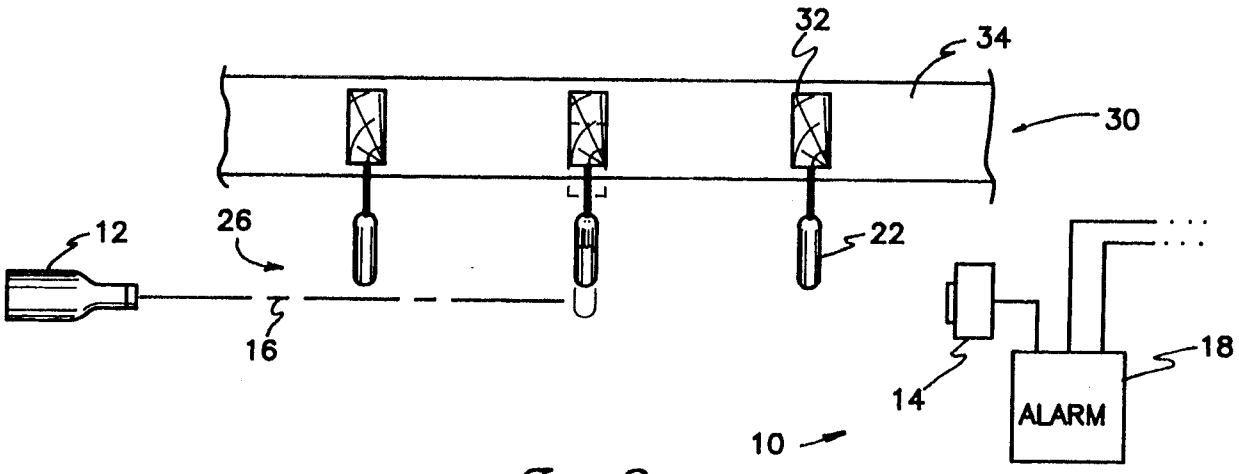
FIG. 2 is a diagrammatic side view of a preferred embodiment of the deflection monitoring system in accordance with the instant invention.

Target blocks 22 are attached to the structure and normally resides along a plane located between the path of laser beam 16 and the structure. For a roof structure, target blocks 22 would define a horizontal plane situated between the roof structure 30 and the horizontal plane defined by laser beams 16. Target blocks 22 may be of any suitable size or shape. In the accompanying figures, block 22 is shown as an ellipsoidal shape, but block 22 may also be rectangular. As shown in FIG. 2, when deflection occurs in the structure 30, the target blocks 22 are concurrently moved into the path of laser beam 16. The corresponding receiver 14 outputs this negative condition to alarm 18.

Figure 3:
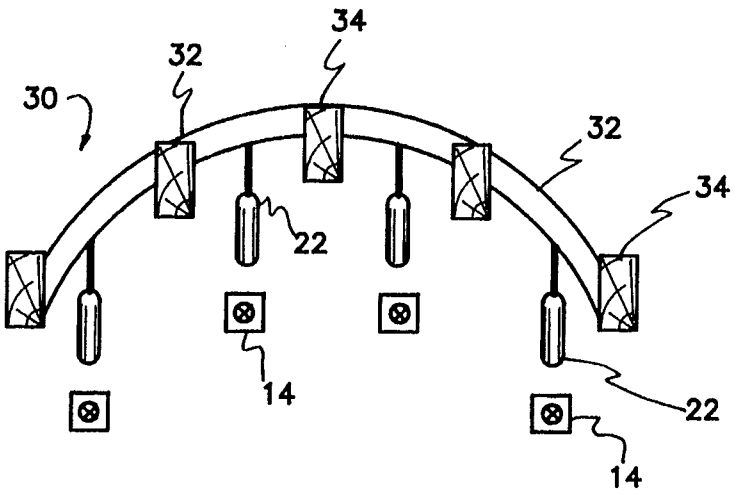
FIG. 3 is a partial elevated view of another preferred embodiment of the deflection monitoring system in conjunction with crowned structures according to the instant invention.

Returning to FIG. 1, the deflection monitoring system 10 is preferably used to detect deflections in the joists 32 of a roof structure 30. Roof structure 30 includes several sets of joists 32, each of which connects two support beams 34 that span the roof. Support beams 34 are preferably I-beams. Joists 32 and beams 34 are often fabricated from structural steel or wood. In FIGS. 1 and 2, joists 32 and beams 34 are depicted as relatively flat structures, but as shown in FIG. 3, the deflection detection system may also be used in conjunction with crowned structures. FIG. 3 shows that joists 32 may be formed to provide a crowned contour.

A target block 22 is preferably positioned at the center of each joist 32, and extends below the joist 32. For crowned joists, as shown in FIG. 3, target block 22 are preferably be located at the crown of joist 32. Though target blocks 22 are preferably affixed to joists 32, depending on the construction of the building, target blocks 22 may instead be affixed to support beams 34. Because the structural framing of the building may affect the placement of target blocks 22, the structural frame may also determine the size and quantity of zones 26.

Target block 22 is normally above laser beam and occupies the open area between joist 32 and laser beam 16. The distance of target block 22 from laser beam 16 determines how much deflection in joist 32 will occur before alarm 18 is triggered by receiver 14. The amount of deflection necessary to trigger alarm 18 depends on the load requirements, modulus of elasticity and flexibility of the joists 32 and beams 34. These factors may be used to calculate the predetermined distance at which lasers 12 and receivers 14 should be placed beneath structure 30 and target blocks 22. Sufficient deflection in any one of the joists 32 caused by, for example, a weight overload condition on the roof, will cause target block 22 to be displaced into the path of laser beam 16, thereby breaking the laser beam's contact with receiver 14. Alarm 18 will signal to a central monitoring station which receiver 14 sent the negative signal, and hence identify in which zone 26 the deflection occurred. Alarm 18 could further produce a visual readout of the structure and the deflection zones so that it can be determined which area of the building was being overstressed before it collapses.

It is to be understood that the instant invention is not limited to the exemplary embodiment described above. It will be apparent to those skilled in the art that various modifications and variations are possible within the spirit and scope of the instant invention. For instance, the lasers could be placed along a vertical plane to detect bellowing or ballooning in a wall. The lasers could also be placed along the horizontal plane of a bridge to detect deflections in the road support structure. In addition, other detectable energy beams, such as normal light waves or microwaves, may be used in place of a laser. The instant invention encompasses any and all embodiments within the scope of the following claims.

I claim:

1. A deflection monitoring system for detecting deflections in structure, said monitoring system comprising:

a laser for generating a laser beam along a path adjacent to the structure;

receiver for receiving said laser beam;

at least one solid target block attached to the structure, extending radially away from the structure, and located between the path of said laser beam and the structure; and an alarm connected to said receiver;

wherein said target block is displaced into the path of said laser beam by a deflection in the structure, wherein said alarm is triggered by said receiver when said receiver no longer receives said laser beam.

2. A deflection monitoring system according to claim 1, wherein said deflection monitoring system detects deflections in the supporting structures of roofs.

3. A deflection monitoring system for detecting deflections in structure, said monitoring system comprising:

a plurality of lasers, each generating a laser beam along a path adjacent to the structure;

a plurality of receivers, each said receiver receiving one of said laser beams;

at least one solid target block attached to the structure, extending radially away from the structure, and located between the path of said laser beam and the structure; and an alarm connected to said receiver means;

wherein said target block is displaced into the path of said laser beam by a deflection in the structure;

wherein said alarm is triggered by said receiver means when said receiver means no longer receives said laser beam.

4. A deflection monitoring system according to claim 3, wherein each laser beam detects deflections within a predetermined zone, and said alarm indicates the zone in which the deflection occurred.

5. A deflection monitoring system according to claim 3, wherein said deflection monitoring system detects deflections in the supporting structures of roofs.

6. A deflection monitoring system for detecting deflections in a roof structure including at least one set of joists connected to support beams of the roof structure, said monitoring system comprising:

a plurality of lasers generating a plurality of laser beams along a path perpendicular to the length of said joists and parallel to said support beams; wherein one said laser beam traverses one said set of said joists;

a plurality of receivers, each receiving one of said plurality of laser beams;

an alarm connected to said receiver means; and at least one solid target block attached to the center of each said joist, extending radially away from said joists, and located between said laser beams and said joists;

wherein said target block is displaced into the path of said laser beam by a deflection of said joist, wherein each laser beam detects deflections within a zone defined by one said set of joists, and wherein said alarm is triggered by said receiver means when said receiver means no longer receives said laser beam.

7. A deflection monitoring system according to claim 6, wherein each said joist is crowned and said target blocks are affixed to the center crowned portion of said joist.

8. A deflection monitoring system according to claim 6, wherein said alarm indicates the zone in which the deflection occurred.

* * * * *